US005298094A

United States Patent [19]

Ota et al.

[11] Patent Number: 5,298,094

[45] Date of Patent: Mar. 29, 1994

[54] ALUMINUM ALLOY CASTING HAVING HIGH STRENGTH AND HIGH TOUGHNESS AND PROCESS FOR PRODUCING THE SAME

[75] Inventors: Atushi Ota, Toyota; Minoru Uozumi, Aichi; Hirokazu Oonishi, Toyota; Yoji Awano; Yoshihiro Shimizu, both of Aichi; Hiroshi Kawahara, Nagoya, all of Japan

[73] Assignees: Toyota Jidosha Kabushiki Kaisha; Kabushiki Toyota Chuo Kenkyusho, both of Japan

[21] Appl. No.: 799,977

[22] Filed: Nov. 29, 1991

[30] Foreign Application Priority Data

Nov. 30, 1990 [JP] Japan ..... 2-338791

[51] Int. Cl.[5] ..... C22F 1/04

[52] U.S. Cl. ..... 148/549; 148/698; 148/700; 148/417; 148/439

[58] Field of Search ..... 420/533, 534, 537, 549, 420/590; 148/3, 159, 417, 439, 700, 698

[56] References Cited

U.S. PATENT DOCUMENTS

| | | | |
|---|---|---|---|
| 1,924,727 | 8/1933 | Rowe et al. | 420/534 |
| 4,336,076 | 6/1982 | Edamura et al. | 148/3 |
| 4,419,143 | 12/1983 | Ito et al. | 148/3 |
| 4,786,340 | 11/1988 | Ogawa et al. | 148/417 |
| 4,808,374 | 2/1989 | Awano et al. | 148/549 |

FOREIGN PATENT DOCUMENTS

| | | |
|---|---|---|
| 63-162832 | 7/1988 | Japan . |
| 1-278567 | 11/1989 | Japan . |
| 521089 | 5/1940 | United Kingdom . |

OTHER PUBLICATIONS

"Effect of Solution Treatment Parameters on Tensile Properties of Cast Aluminum Alloys" by S. Shiykumar et al., 6057 Journal of Heat Treating, vol. 8, pp. 63–70, No. 1, 1990.

*Primary Examiner*—R. Dean
*Assistant Examiner*—Robert R. Koehler
*Attorney, Agent, or Firm*—Finnegan, Henderson, Farabow, Garrett & Dunner

[57] ABSTRACT

Disclosed are an aluminum alloy casting having a high strength and a high toughness, and a production process for the same. The aluminum alloy casting comprises silicon (Si) in an amount of 2.5 to 4.4% by weight, copper (Cu) in an amount of 1.5 to 2.5% by weight, magnesium (Mg) in an amount of 0.2 to 0.5% by weight and the balance of aluminum (Al), and a matrix thereof includes a dendrite which has a size of 30 micrometers or less. Since the Si addition amount is suppressed as less as possible and since the size of the dendrite is micro-fined in the aluminum alloy casting, the toughness is improved remarkably. Further, since the Cu and Mg are added in the predetermined addition amounts, the strength is enhanced in the aluminum alloy casting. In addition, a solution treatment which is employed in the production process can further enhance the strength of the aluminum alloy casting.

11 Claims, 6 Drawing Sheets

ALUMINUM ALLOY CASTING HAVING HIGH STRENGTH AND HIGH TOUGHNESS AND PROCESS FOR PRODUCING THE SAME

BACKGROUND OF THE INVENTION

1. Field of the Invention

The present invention relates to an aluminum alloy casting having a high strength and a high toughness (hereinafter simply referred to as an "aluminum alloy casting") which is appropriate for parts, such as automotive parts or the like, which are required to have a strength and a toughness, and to a process for producing the same.

2. Description of the Related Art

There has been an aluminum alloy forged product, for instance, "6061" or the like as per Japanese Industrial Standard (hereinafter abbreviated to as "JIS"). It has been known that it provides the following advantages. Namely, it has less internal defects, it is superior in the strength and toughness, and accordingly it is highly reliable in view of quality. However, it suffers from a high cost.

On the other hand, an aluminum alloy casting, for instance, a casting made from "AC4C" or the like as per JIS, provides an advantage because it is less expensive than the aluminum forged product. However, completed parts should be enlarged because the aluminum alloy casting has a lower strength and a lower toughness, and because it is less reliable. Accordingly, the parts suffer from increased weights, and the merits of the weight reduction resulting from the aluminum alloy casting application have been diminished.

Silicon (Si) which has been added to improve the castability of the aluminum alloy is believed to be one of the causes which deteriorates the strength and the toughness of an aluminum alloy casting. In particular, Si is believed to deteriorate the toughness.

SUMMARY OF THE INVENTION

It is therefore a primary object of the present invention to reduce an amount of Si which adversely affects the toughness of an aluminum alloy casting as much as possible, and to increase amounts of elements which improve the strength and the toughness thereof as much as possible, thereby not only enhancing the strength and the toughness thereof but improving the reliability thereof as well.

Further, it is a secondary object of the present invention to enable to cast such an aluminum alloy with ease under a predetermined pressure application.

In a first aspect of the present invention, there is provided an aluminum alloy casting having a high strength and a high toughness in order to achieve the primary objective, the aluminum alloy casting which consists essentially of:

silicon (Si) in an amount of 2.5 to 4.4% by weight;

copper (Cu) in an amount of 1.5 to 2.5% by weight;

magnesium (Mg) in an amount of 0.2 to 0.5% by weight; and aluminum (Al), substantially the balance; and a matrix of the aluminum alloy casting including a dendrite which has a size of 30 micrometers or less.

In a second aspect of the present invention, there is provided a process for producing an aluminum alloy casting having a high strength and a high toughness in order to achieve the secondary objective, the process which comprises the steps of:

a melting step of melting a raw material consisting essentially of:

silicon (Si) in an amount of 2.5 to 4.4% by weight;

copper (Cu) in an amount of 1.5 to 2.5% by weight;

magnesium (Mg) in an amount of 0.2 to 0.5% by weight; and aluminum (Al), substantially the balance;

a squeeze casting step of squeeze casting a molten metal of the raw material with a mold while applying a pressure of 250 to 1500 kgf/cm$^2$ thereto; and a heat treatment step of carrying out a solution treatment onto a cast product.

The present invention will be hereinafter described more in detail. The chemical elements and the addition amounts thereof which are common in both of the aluminum alloy casting and the raw material of the first and second aspect of the present invention are limited because of the following reasons:

(a) Si Si affects the toughness and the castability of the aluminum alloy casting. Namely, when Si is included in an addition amount less than 2.5% by weight, the castability is adversely affected and hot tearings occur in the aluminum alloy casting. When Si is included in an addition amount more than 4.4% by weight, the toughness deteriorates. Hence, Si is included in the addition amount of 2.5 to 4.4% by weight. The Si addition amount is further preferred to fall in a range of 3.0 to 4.0% by weight;

(b) Cu Cu is an advantageous element for improving the strength of the aluminum alloy casting. However, when Cu is included in an addition amount less than 1.5% by weight, such a Cu addition amount does not improve the strength. When Cu is included in an addition amount more than 2.5% by weight, the corrosion resistance and the stress-corrosion cracking resistance deteriorate. Hence, Cu is included in the addition amount of 1.5 to 2.5% by weight. The Cu addition amount is further preferred to fall in a range of 1.8 to 2.3% by weight;

(c) Mg Mg is also an advantageous element for improving the strength of the aluminum alloy casting. However, when Mg is included in an addition amount less than 0.2% by weight, such an Mg addition amount does not improve the strength. When Mg is included in an addition amount more than 0.5% by weight, the toughness deteriorates. Hence, Mg is included in the addition amount of 0.2 to 0.5% by weight. The Mg addition amount is further preferred to fall in a range of 0.3 to 0.5% by weight; and (d) Sr In the present aluminum alloy casting and the production process therefor, it is preferred that Sr is further included in an amount of 0.005 to 0.2% by weight. Sr is an effective element in modifying and spheroidizing eutectic Si phases. Sr affects the strength and the toughness of the aluminum alloy casting, and it especially contributes to the stabilization of the mechanical properties. Sr is an effective element also to repress the segregation of the eutectic phases. However, when Sr is included in an addition amount less than 0.005% by weight, the eutectic Si phases are not modified sufficiently. When Sr is included in an addition amount more than 0.2% by weight, Sr compounds crystallize to deteriorate the mechanical properties, in particular, the elongation. Hence, Sr is included in the addition amount of 0.005 to 0.2% by weight.

In general, Sr has been sometimes added in order to modify the eutectic Si phases of an Al-Si alloy which has a slow solidifying speed. Accordingly, in the production of an aluminum alloy casting which has a fast solidifying speed like the present aluminum alloy casting, Sr has not been added because it has been believed that the eutectic Si phases crystallize finely to reduce the Sr addition effect. However, in the present invention, the present inventors dare to add Sr to further modify the eutectic Si phases in order to eliminate the scatter in the generation of the mechanical properties. Further, in the present invention, the addition of Sr represses the segregation of the eutectic phases and effects the advantage of stably giving the superior mechanical properties to the present aluminum alloy casting.

The size of the dendrite is limited in the first aspect of the present invention because of the following reason:

The smaller the size, the more the toughness of the aluminum alloy casting is improved. Accordingly, it is preferred that the dendrite is as small as possible. However, when the size is more than 30 micrometers, the toughness cannot be expected to be improved so much. Thus, the dendrite is adapted to have the size of 30 micrometers or less. The size is further preferred to be not more than 2.5 micrometers.

The pressure which is applied to the molten metal in the squeeze casting step of the second aspect of the present invention is limited because of the following reason:

The aluminum alloy casting according to the present invention exhibits the castability in a lesser degree relatively. Accordingly, the pressure of 250 to 1500 kgf/cm$^2$ is applied to the molten metal of the raw material. When a pressure of less than 250 kgf/cm$^2$ is applied thereto, the shrinkage porosities occur at heavy thickness sections of the aluminum alloy casting, and they result in the cracks in the casting. When a pressure of more than 1500 kgf/cm$^2$ is applied thereto, the castability is hardly improved. Hence, the pressure of 250 to 1500 kgf/cm$^2$ is applied thereto. The pressure is further preferred to fall in a range of 300 to 1000 kgf/cm$^2$.

Regarding the heat treatment (i.e., the solution treatment) of the heat treatment step of the second aspect of the present invention, the higher the temperature of the solution treatment, the faster the elements such as Cu, Mg and Si diffuse in the aluminum alloy casting. Accordingly, the time required for the solution treatment can be reduced. Hence, it is preferred to carry out the solution treatment at a high temperature. However, when the temperature of the solution treatment is too high, the burning occurs and thereby the strength of the aluminum alloy casting deteriorates sharply. Therefore., the conditions of the heat treatment are set as follows. Namely, the cast product is left at a temperature of 520° to 550° C. for 3 to 10 hours, and thereafter it is quenched with water. It is further preferred to leave the cast product at a temperature of 530° to 535° C. for 3 to 6 hours. Finally, the cast product is left at an aging temperature of 150° to 190° C. for 2 to 10 hours. It is further preferred to leave the cast product at an aging temperature of 160° to 180° C. for 2 to 6 hours. With the heat treatment which is carried out under such conditions, the elements, such as Cu, Mg, Si or the like, which have not been dissolved into an Al matrix by the conventional solution treatments, can be uniformly dissolved into an Al matrix in appropriate amounts, and at the same time the eutectic Si phases can be well spheroidized. As a result, the strength and the toughness of the aluminum alloy casting is improved more by the present heat treatment than by the conventional heat treatments.

The size of the spheroidized eutectic Si phases is preferred to be not more than 20 micrometers. When the size of the spheroidized eutectic Si phases falls in this range, it contributes to the improvement of the strength and toughness to the aluminum alloy casting. Moreover, as described above, when Sr is further included in an addition amount of 0.005 to 0.2% by weight in the present aluminum alloy casting and raw material, the spheroidization of the eutectic Si phases is facilitated by the Sr addition, and the size of the spheroidized eutectic Si phases is modified as small as 10 micrometers or less. As a result, the Sr addition affects the strength and toughness of the aluminum alloy casting favorably.

In addition, when air is involved during the casting operation, defective castings might occur. Hence, it is preferred to evacuate the inside of the mold to a vacuum degree of 30 Torr or less before the casting operation in order to inhibit the defective castings from occurring.

Since the Si addition amount is suppressed as little as possible and since the size of the dendrite is micro-fined in the present invention, the toughness of the aluminum alloy casting is improved. In addition, the Cu and Mg are added in the predetermined addition amounts so that the strength of the aluminum alloy casting is enhanced in the present invention.

The deterioration of the castability of the aluminum alloy casting, which might result from the suppressed Si addition amount, can be suppressed as little as possible by carrying out the squeeze casting in the predetermined pressure range. Further, the appropriately arranged heat treatment can also enhance the strength of the aluminum alloy casting.

Thus, the present invention enables to provide an aluminum alloy casting having a high strength and a high toughness and the process for producing the same at a less expensive production cost. Naturally, the aluminum alloy casting is superior to conventional aluminum alloy castings, or even to conventional aluminum alloy forged products, in strength and toughness, and accordingly it is highly reliable.

BRIEF DESCRIPTION OF THE DRAWINGS

A more complete appreciation of the present invention and many of its advantages will be readily obtained as the same becomes better understood by reference to the following detailed description when considered in connection with the accompanying drawings and detailed specification, all of which forms a part of the disclosure.

DETAILED DESCRIPTION OF THE PREFERRED EMBODIMENTS

Having generally described the present invention, a further understanding can be obtained by reference to the specific preferred embodiments which are provided herein for purposes of illustration only and are not intended to limit the scope of the appended claims.

FIRST PREFERRED EMBODIMENT

In the First Preferred Embodiment, a raw material was melted so as to make an aluminum alloy which consisted essentially of Si in an amount of 4. 0% by weight, Cu in an amount of 2. 0% by weight, Mg in an amount of 0. 3% by weight, and substantially the balance of Al as well as inevitable impurities. The melted raw material was cast into a suspension arm.

Figure 1:
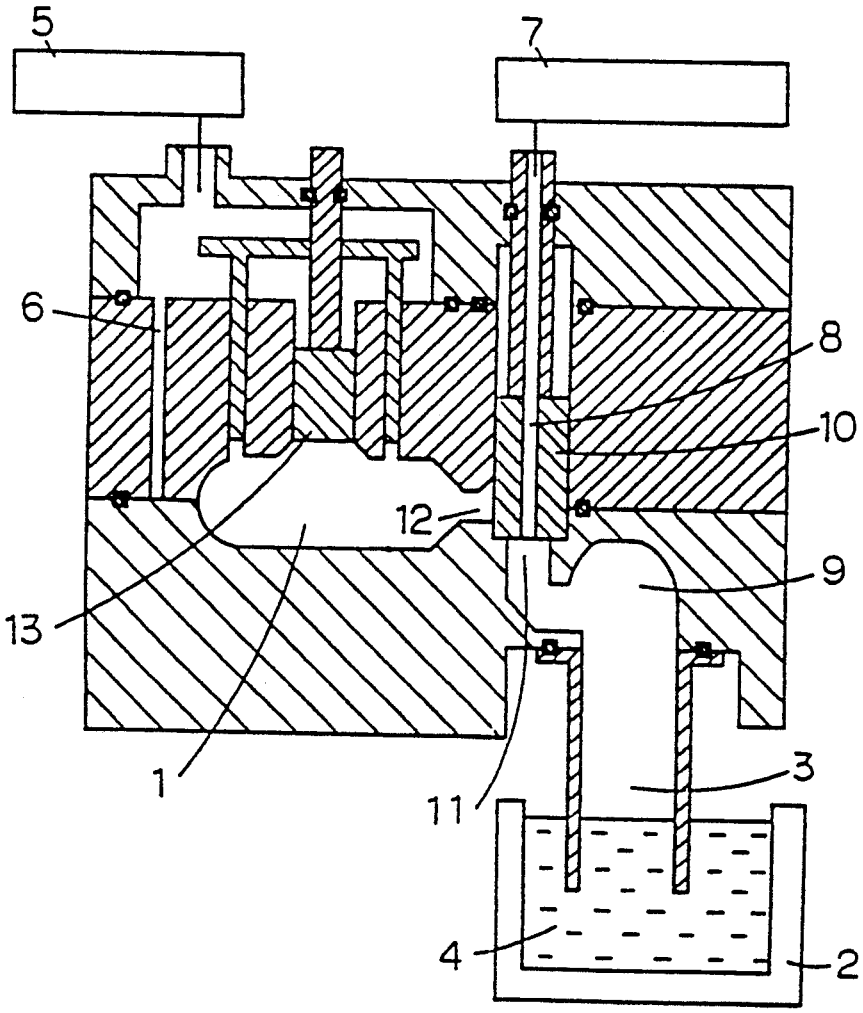
FIG. 1 is a cross sectional view of a major portion of a squeeze casting apparatus which is employed in a First Preferred Embodiment according to the present invention.

A casting apparatus as illustrated in FIG. 1 was employed for the casting operation. First of all, the casting apparatus will be hereinafter described. The casting apparatus was a squeeze casting apparatus. The squeeze casting apparatus comprised a cavity 1 which was formed in a mold thereof, a melting furnace 2, and a molten metal passage 3 which was adapted for connecting the cavity 1 and the melting furnace 2.

During the casting operation, a temperature of a molten metal 4 in the melting furnace 2 was raised to 720° C. at first so that the melted raw material became an aluminum alloy which consisted essentially of Si in an amount of 4.0% by weight, Cu in an amount of 2.0% by weight, Mg in an amount of 0.3% by weight, and substantially the balance of Al as well as inevitable impurities. Then, the casting operation was carried out while maintaining a temperature of the mold at 200° C.

The casting process will be hereinafter described in detail. A vacuum pump 5 was actuated at first so as to evacuate within the cavity 1 by way of a vacuum passage 6. The cavity 1 was evacuated to a vacuum degree of 15 Torr.

Immediately before the evacuation step is completed, a decompression pump 7 was actuated so as to decompress within a reservoir 9 and the molten metal supply passage 3. As a result, the molten metal 4 in the melting furnace 2 was raised to a position immediately below a shut-off member 10 of the mold.

Simultaneously with the completion of the decompression step, the shut-off member 10 was ascended quickly so as to communicate the cavity 1 with the molten metal supply passage 3 by way of a communication passage 11 of the mold. At this moment, the molten metal 4 was flowed into the cavity 1 by a pressure difference between the pressures in the cavity 1 and the molten metal supply passage 11. When the molten metal 4 was flowed into the cavity 1, the molten metal 4 passed through a gate portion 12 at a speed (i. e. , a gate speed) of 3000 mm/sec.

When the cavity 1 was filled with the molten metal 4, the shut-off member 10 was descended so as to close the cavity 1 at the same time. Then, a pressure applying member 13 of the mold was descended so that a pressure of 1000 kgf/cm$^2$ was applied to the molten metal 4 in the cavity 1. The molten metal 4 was thus pressurized and solidified in the cavity 1.

A solution treatment was carried out onto the thus obtained cast product at a temperature of 535° C. for 3 hours. With the solution treatment, the Cu, Mg and Si elements could quickly and uniformly dissolve in a matrix of the cast product in appropriate addition amounts. Thereafter, the cast product was quenched with water whose temperature was held at 80° C. Finally, the cast product was aged at a temperature of 160° C. for 5 hours. The suspension arm of the First Preferred Embodiment was thus obtained, and it had a minimum thickness of 3 mm.

The suspension arm of the First Preferred Embodiment was subjected to a tensile test. According to the results of the tensile test, the suspension arm had a tensile strength of 39 kgf/mm$^2$ and an elongation of 14%. The elongation associates with the toughness of the suspension arm. Further, a microstructure of the suspension arm was observed with an optical microscope. According to the observation, a size of its dendrite was found to be approximately 20 micrometers in the matrix, and the eutectic Si phases were also found to b, well spheroidized in the microstructure.

For a comparison purpose, another suspension arm was cast as a Comparative Example 1 under the same conditions as those of the First Preferred Embodiment described above. However, a conventional aluminum alloy (AC4CH as per JIS) was employed as a raw material instead of the raw material of the First Preferred Embodiment. The conventional aluminum alloy AC4CH consists essentially of Si in an amount of 8.1% by weight, Mg in an amount of 0.3% by weight, and substantially the balance of Al as well as inevitable impurities.

Likewise, the suspension arm of the Comparative Example 1 was subjected to the tensile test. According to the results of the tensile test, the suspension arm had a tensile strength of 30 kgf/mm$^2$ and an elongation of 4%. Further, a microstructure of the suspension arm was also observed with an optical microscope. According to the observation., a size of its dendrite cell was found to be approximately 35 micrometers in the matrix, and the eutectic Si phases were not found to be properly spheroidized in the microstructure.

In addition, a relationship between a vacuum degree in the cavity 1 during the evacuation step and a rejection ratio resulting from the air inclusion in the molten metal 4 was examined by using the casting apparatus employed in the First Preferred Embodiment. The results of the examination are illustrated in FIG. 2.

Figure 2:
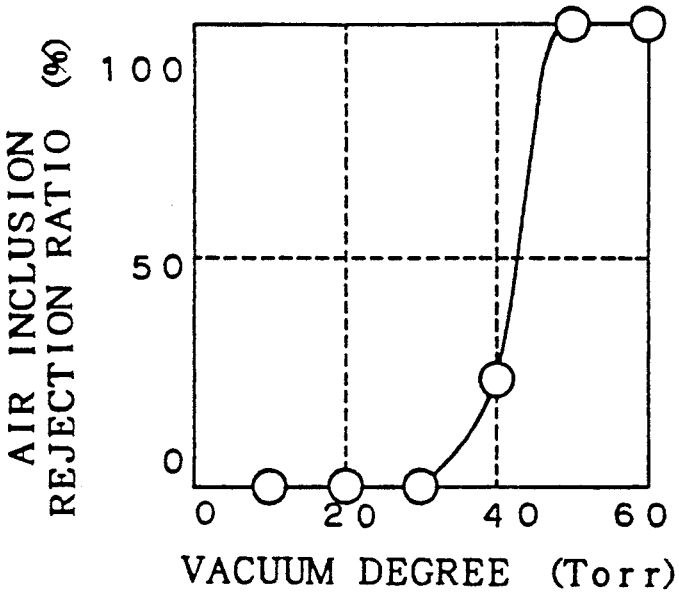
FIG. 2 is a graph illustrating a relationship between a vacuum degree in a cavity of the squeeze casting apparatus, which is employed in the First Preferred Embodiment, and a rejection ratio resulting from the air inclusion in the squeeze casting apparatus.

According to FIG. 2, it was found that the rejection ratio was substantially zero when the vacuum degree was 30 Torr or less in the casting apparatus. When the above-described casting operation is used, the relationship between the vacuum degree in the cavity 1 and the rejection ratio is effected for all the cases irrespective of the configurations of the cavity 1.

The casting operation was carried out after evacuating the cavity 1 in the First Preferred Embodiment. When such a casting operation is used, the defectives, which have been resulting from the air inclusion, can be effectively inhibited from occurring during the casting operation, particularly during the casting operation for parts having heavy wall thicknesses.

SECOND PREFERRED EMBODIMENT

In the Second Preferred Embodiment, a casting apparatus as illustrated in FIG. 1 was employed in order to cast an automobile carrier with an aluminum alloy according to the present invention. The aluminum alloy consisted essentially of Si in an amount of 3.0% by weight, Cu in an amount of 2.5% by weight, Mg in an amount of 0.4% by weight, and substantially the balance of Al as well as inevitable impurities. The casting apparatus was substantially identical with that of the First Preferred Embodiment other than that a configuration of the cavity 1 is adapted to cast the automobile carrier. The casting conditions were set as follows:

| | |
|---|---|
| a temperature of the molten metal 4; | 700° C., |
| a temperature of the mold; | 200° C., |
| a vacuum degree in the cavity 1 before pouring the molten metal 4; | 15 Torr, |
| a flow speed of the molten metal 4 at the gate portion 12; | 1000 mm/sec, and |
| a pressure applied with the pressure applying member 13; | 800 kgf/cm$^2$. |

After the casting is completed, a solution treatment was carried out onto the thus obtained cast product at a temperature of 535° C. for 3 hours. Thereafter, the cast product was quenched with water whose temperature was held at 80° C. Finally, the cast product was aged at a temperature of 180° C. for 3 hours. The automobile carrier of the Second Preferred Embodiment was thus obtained, and it had a minimum thickness of 5 mm. Further, in the automobile carrier, a size of its dendrite was found to be approximately 20 micrometers in the matrix.

For a comparison purpose, another automobile carrier was cast as a Comparative Example 2 under the same conditions as those of the Second Preferred Embodiment described above. However, the conventional aluminum alloy (AC4CH as per JIS) was employed as a raw material instead of the raw material of the Second Preferred Embodiment.

The automobile carriers of the Second Preferred Embodiment and the Comparative Example 2 were subjected to the tensile test. According to the results of the tensile test, the automobile carrier of the Second Preferred Embodiment had a tensile strength of 41 kgf/mm$^2$ and an elongation of 10%. On the other hand, the automobile carrier of the Comparative Example 2 had a tensile strength of 31 kgf/mm$^2$ and an elongation of 6%. Thus, it is apparent that automobile carrier of the Second Preferred Embodiment exhibited a strength and a toughness far superior to those of the Comparative Example 2.

EVALUATION

First Evaluation

A First Evaluation was carried out in order to verify the limitation of the Si addition amount. First of all, the results of the First Evaluation will be hereinafter described in detail. In the First Evaluation, the variation of the elongations of cast products were evaluated while varying the Si addition amount. The First Evaluation was carried out as follows.

Namely, Al-Si-Cu-Mg alloys were prepared. The alloys consisted 2.0% by weight of Cu, 0.3% by weight of Mg, various percentages by weight of Si, and substantially the balance of Al. The Si addition amount was varied from 1.0, 2.0, 3.0, 4.0, 5.0, 6.0, and to 7.0% by weight. Hence, seven alloys were cast into seven cylindrical test specimens which had a diameter of 30 mm with a mold under the following conditions:

a temperature of the molten metal; 800° C.,
a temperature of the mold; 150° C., and
a pressure applied to the molten metal; 500 kgf/cm$^2$.

For a comparison purpose, another seven test specimens were cast from the same seven alloys with the same mold. However, a gravity casting in which a pressure of approximately 0.1 kgf/cm$^2$ was applied to the molten metals was employed this time, and it was carried out under the following thermal conditions:

a temperature of the molten metal; 760° C., and
a temperature of the mold; 150° C.

Test samples were machined out of these test specimens thus obtained, and they had a configuration in accordance with the JIS #4 sample. Then, the test samples were subjected to solution treatments which were carried out in a temperature range of 530° to 540° C. depending on the compositions of the alloys for 4 hours. After the solution treatments, the test samples were quenched with water whose temperature was held at 80° C. Finally, the test samples were aged at a temperature of 160° C. for 4 hours. The thus obtained test samples were subjected to the tensile test. The results of the tensile test are illustrated in FIG. 3.

Figure 3:
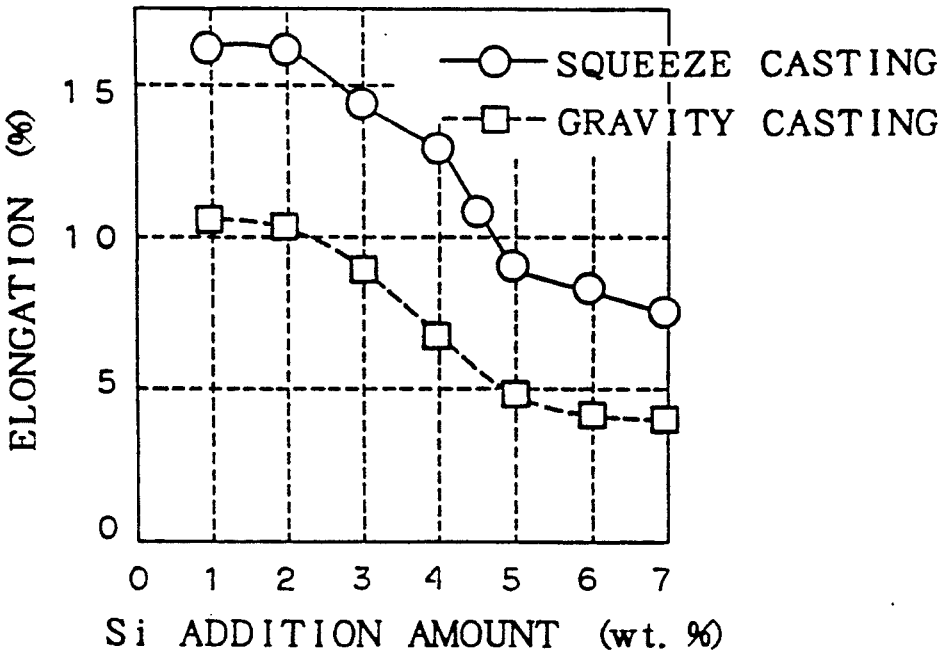
FIG. 3 is a graph illustrating variations of elongations of aluminum alloy castings whose Si addition amounts are varied.

As can be seen from FIG. 3, no test samples were expected to exhibit sufficient elongations when both of the 500 kgf/cm$^2$ squeeze casting and the gravity casting were carried out onto the alloys having the Si addition amount of more than 4.4% by weight. On the other hand, when the 500 kgf/cm$^2$ squeeze casting was carried out onto the alloys having the Si addition amount of 4.4% or less, the thus obtained test samples exhibited far better elongations than the test sample which was obtained by carrying out the gravity casting onto the alloy having the Si addition amount of 1.0% by weight.

Also in the First Evaluation, the variation of the crack rejection ratios of cast products were evaluated while varying the Si addition amount. This evaluation was carried out as follows.

Namely, aluminum alloys were cast into test samples with a mold under similar casting conditions which were employed to prepare the test specimens for the above-described tensile strength test. The aluminum alloys had the same compositions, and they were the same ones which were cast into the test specimens and which were examined for their tensile strengths as described above. The test samples had a cylindrical tube shape which had a maximum diameter of 20 mm and a minimum diameter of 8 mm. The thus obtained test samples were visually examined for the occurrence of cracks. The results of the crack rejection ratio evaluation are illustrated in FIG. 4.

Figure 4:
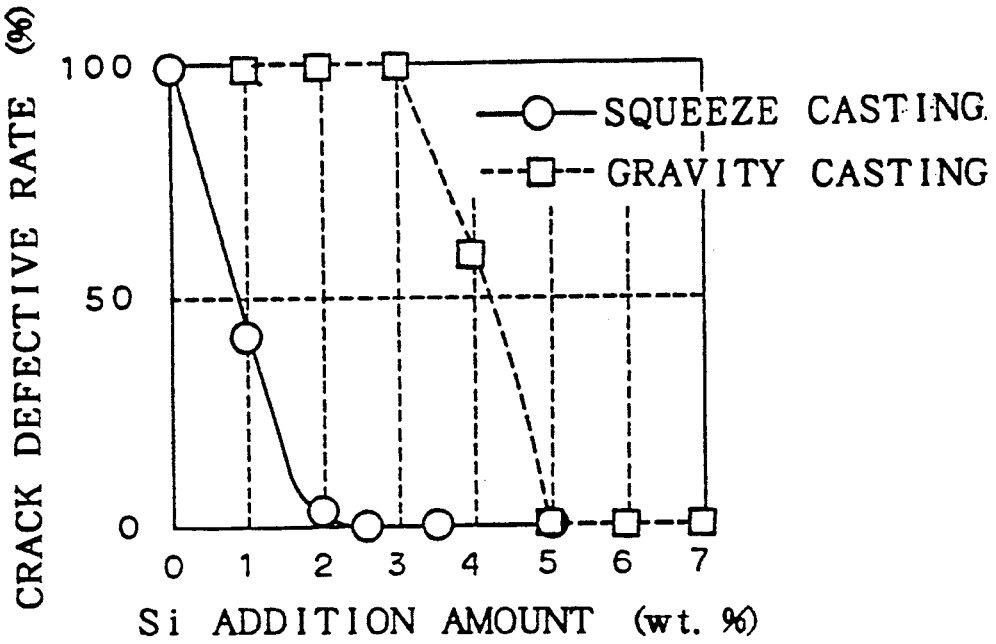
FIG. 4 is a graph illustrating variations of crack rejection ratios of aluminum alloy castings whose Si addition amounts are varied.

It is apparent from FIG. 4 that the cracks occurred when the gravity casting was carried out onto the aluminum alloys having the Si addition amount of 5.0% by weight or less. On the other hand, in the case of the 500 kgf/cm$^2$ squeeze casting, no cracks occurred until the Si addition amount was 2.5% by weight or less.

According to the results of the tensile strength test and the crack rejection ratio evaluation, it is required to carry out a high squeeze casting in order not to cause the cracks in a cast product but in order to give an appropriate elongation (or toughness) to a cast product. In particular, when the 500 kgf/cm$^2$ squeeze casting are carried out, it is required to adjust the Si addition amount to fall in a range of 2.2 to 4.4% by weight.

Second Evaluation

A Second Evaluation was carried out in order to verify the limitation of the Cu addition amount. In the Second Evaluation, the variation of the tensile strengths of cast products were evaluated while varying the Cu addition amount. The Second Evaluation was carried out as follows.

Namely, Al-Si-Cu-Mg alloys were prepared. The alloys consisted 3.0% by weight of Si, 0.3% by weight of Mg, various percentages by weight of Cu, and substantially the balance of Al. The Cu addition amount was varied from 0, 0.5, 1.0, 1.5, 2.0, 2.5, and to 3.0% by weight. The alloys were cast into cylindrical test specimens which had a diameter of 30 mm with a mold under the following conditions:

a temperature of the molten metal; 800° C.,
a temperature of the mold; 150° C., and
a pressure applied to the molten metal; 500 kgf/cm$^2$.

Test samples were machined out of these test specimens thus obtained, and they had a configuration in accordance with the JIS #4 sample. Then, the test samples were subjected to solution treatments which were carried out in a temperature range of 530° to 540° C. depending on the compositions of the alloys for 4 hours. After the solution treatments,, the test samples were quenched with water whose temperature was held at 80° C. Finally, the test samples were aged at a temperature of 160° C. for 4 hours. The thus obtained test samples were subjected to the tensile test. The results of the tensile test are illustrated in FIG. 5.

Figure 5:
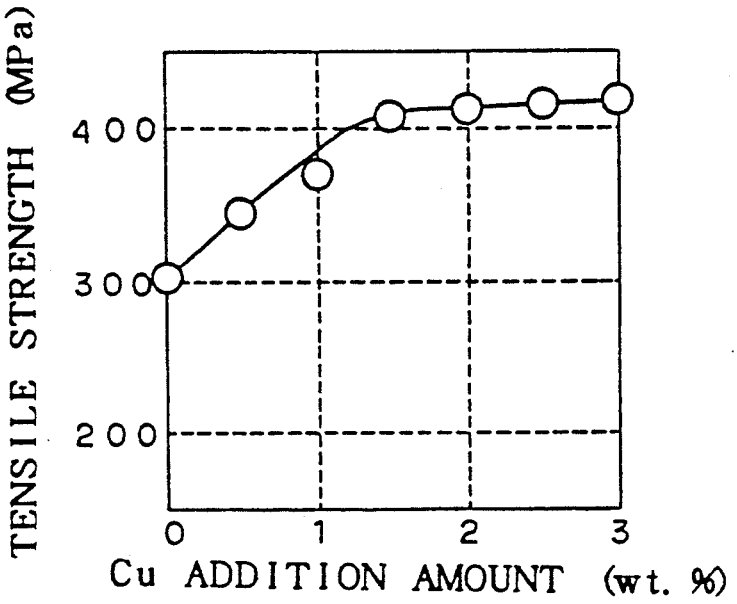
FIG. 5 is a graph illustrating a variation of a tensile strength of aluminum alloy castings whose Cu addition amounts are varied.

As can be seen from FIG. 5, the test samples started to deteriorate the tensile strength when the Cu addition amount was 1.5% by weight or less. In addition, it has been known that the corrosion resistance and the stress-corrosion cracking resistance deteriorate when Cu is added in a greater amount. It is apparent from FIG. 5 that the tensile strength was hardly improved when the Cu addition amount was 2.5% by weight or more. Hence, when the 500 kgf/cm$^2$ squeeze casting is carried out onto the molten aluminum alloy having the Cu addition amount of 1.5 to 2.5% by weight, a cast product can be obtained which not only has an appropriate elongation but also a favorable corrosion resistance and stress-corrosion cracking resistance.

Third Evaluation

A Third Evaluation was carried out in order to verify the limitation of the size of the dendrite in the matrix of the aluminum alloy casting. In the Third Evaluation, the variation of the elongations (or toughnesses) of cast products was evaluated while varying the size of the dendrite in the matrix. The Third Evaluation was carried out as follows.

Namely, an Al-Si-Cu-Mg alloy was prepared. The alloy consisted 3.0% by weight of Si, 0.3% by weight of Mg, 2.0% by weight of Cu, and substantially the balance of Al as well as the inevitable impurities. The alloy was melted and cast into cylindrical test specimens which had a diameter of 30 mm with a mold under the following conditions:

a temperature of the molten metal; 750° C.,
a temperature of the mold; 150° C., and
a pressure applied to the molten metal; various pressures.

Test samples were machined out of these test specimens thus obtained, and they had a configuration in accordance with the JIS #4 sample. Then, the test samples were subjected to a solution treatment which was carried out at a temperature of 535° C. for 4 hours. After the solution treatment, the test samples were quenched with water whose temperature was held at 80° C. Finally, the test samples were aged at a temperature of 160° C. for 4 hours. The thus obtained test samples were subjected to the tensile test. Further, the test samples which were employed in the tensile test were cut in order to measure the sizes of the dendrites in the cut cross sections of the test samples at their central portions. The relationship between the sizes of the dendrites of the test samples and their elongations are illustrated in FIG. 6.

Figure 6:
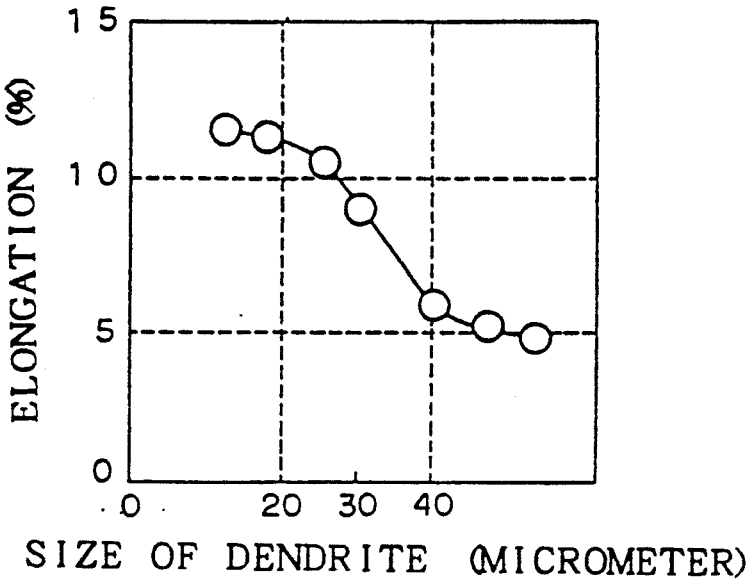
FIG. 6 is a graph illustrating a variation of an elongation of aluminum alloy castings whose sizes of dendrite are varied in their matrices thereof.

As can be seen from FIG. 6, the elongation decreased sharply when the size of the dendrite was 30 micrometers or more. Hence, the size of the dendrite is adapted to be 30 micrometers or less in the matrix of the aluminum alloy casting.

Fourth Evaluation

A Fourth Evaluation was carried out in order to verify the limitation of the casting pressure to be applied to the molten metal. According to the aluminum alloy casting of the First and Second Preferred Embodiment, it has been known that the elongation, the crack rejection ratio and the tensile strength are closely related to the micro-fined structure of the aluminum alloy casting. In the above-described First and Second Evaluation, the casting operation was carried out while applying the pressure of 500 kgf/cm$^2$. However, in the Fourth Evaluation, the casting pressure was varied in order to find out an optimum casting pressure for producing the aluminum alloy casting.

In the Fourth Evaluation, the variation of the sizes of the dendrites in the aluminum alloy castings was evaluated while varying the casting pressure. The Fourth Evaluation was carried out as follows.

Figure 7:
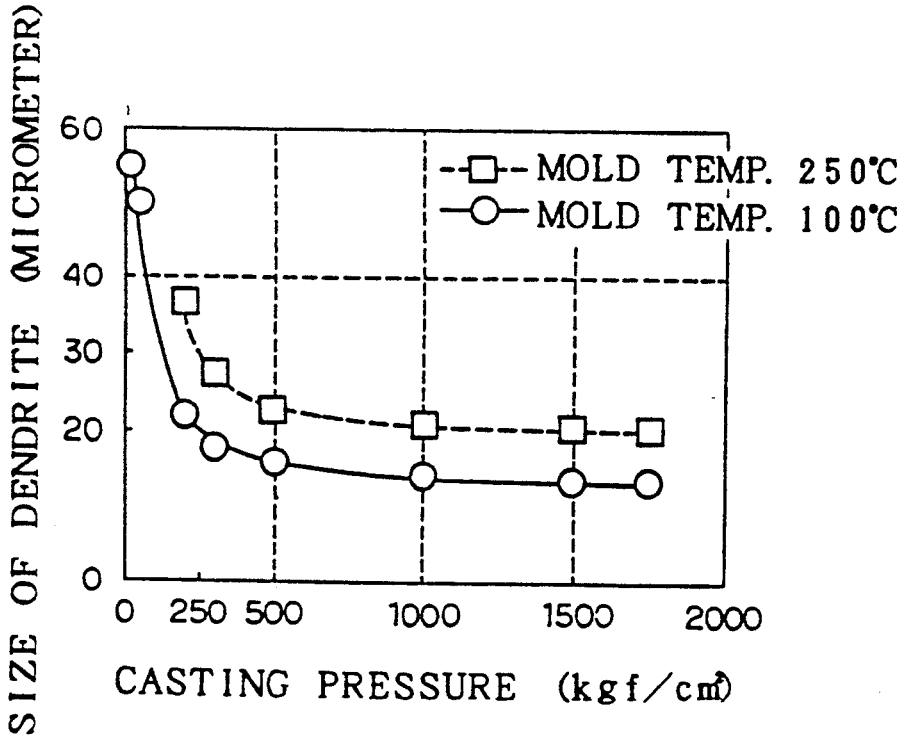
FIG. 7 is a graph illustrating variations of sizes of dendrite in matrices of aluminum alloy castings which are obtained by varying their casting pressures.

Namely, an Al-Si-Cu-Mg alloy was prepared. The alloy consisted 3.0% by weight of Si, 0.3% by weight of Mg, 2.0% by weight of Cu, and substantially the balance of Al. The alloy was melted and cast into test specimens with a mold which had a cavity of 30 mm-diameter cylindrical configuration. During the casting operation, a temperature of the molten metal was held at 750° C., and a temperature of the mold was held either at 250° C. or 100° C. In this way, the sizes of the dendrites in the aluminum alloy castings were varied in order to evaluate how the sizes depended on the casting pressures. The results of the Fourth Evaluation are illustrated in FIG. 7.

In the case of a casting having an ordinary thickness, the molten metal flows around the cavity of the mold fully even when the temperature of the mold is 100° C. However, in the case of a casting having a minimum thickness as small as 3 mm, the molten metal cannot flow around the cavity of the mold fully. In the case that the temperature of the mold was held at 250° C., it is apparent from FIG. 7 that the size of the dendrite increased to sharply deviate from the size of 30 micrometers and that the elongation started to decrease sharply as set forth in the section of the "Third Evaluation" when the casting operation was carried out under the casting pressure of less than 250 kgf/cm$^2$. On the other hand, the size of the dendrite did not change at all, nor the elongation changed even when the casting pressure was increased and the casting operation was carried out under the casting pressure of more than 1500 kgf/cm$^2$. In addition, it is hard to increase the casting pressure in view of the equipment, and it requires much cost to do so. Therefore, the casting operation is carried out in the casting pressure range of 250 to 1500 kgf/cm$^2$.

Further, in the First and Second Evaluation, the casting pressure of 500 kgf/cm$^2$ was applied to the molten metals in order to obtain the test specimens, and the limitations of the Si and Cu addition amounts were verified under the casting pressure condition. As can be seen from FIG. 7, since the size of the dendrite hardly changed in a casting pressure range of 250 to 1500 kgf/cm$^2$ and since the castability and the mechanical property of the aluminum alloy casting depended on the size of the dendrite, the limitations of the Si and Cu addition amounts which were verified in the First and Second Evaluation hold also true for the aluminum alloy castings which are cast under the casting pressure range of 250 to 1500 kgf/cm$^2$.

Fifth Evaluation

A Fifth Evaluation was carried out in order to compare the tensile strength and the elongation of the aluminum alloy casting according to the present invention with those of a conventional aluminum alloy casting and a conventional aluminum alloy forged product. The aluminum alloy casting according to the present invention was prepared with the same raw material as the First Preferred Embodiment under the same conditions for preparing the aluminum alloy casting of the First Preferred Embodiment. The conventional aluminum alloy casting was prepared with an conventional aluminum alloy (AC4CH as per JIS) under the same conditions for preparing the First Preferred Embodiment. The conventional aluminum alloy forged product was prepared with the conventional aluminum alloy ("6061" as per JIS). However, in the Fifth Evaluation, the castings and forged products were formed into the cylindrical test specimens having a diameter of 30 mm which were prepared in the First Evaluation, and the test specimens were machined to the test samples which had a configuration in accordance with the JIS #4 sample. The conventional aluminum alloy AC4CH consists essentially of Si in an amount of 8.1% by weight, Mg in an amount of 0.3% by weight, and substantially the balance of Al as well as inevitable impurities. The conventional aluminum alloy 6061 consists essentially of Si in an amount of 0.6% by weight, Mg in an amount of 1.0% by weight, and substantially the balance of Al as well as inevitable impurities.

Figure 8:
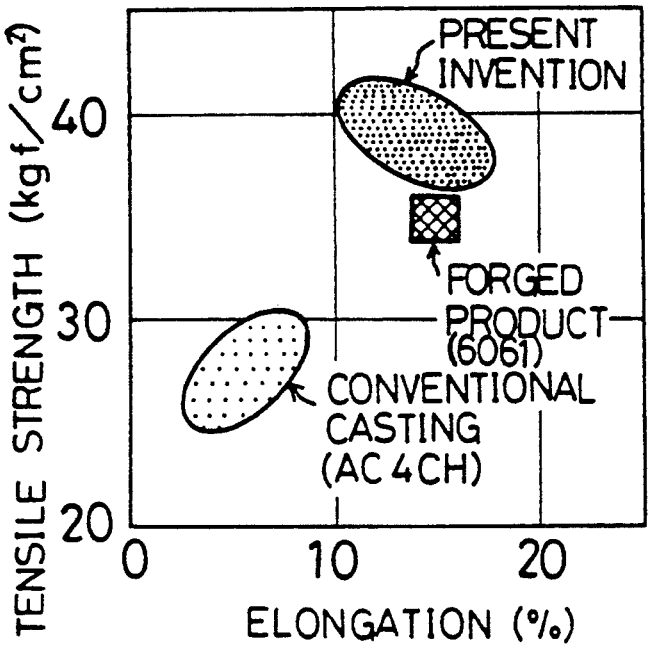
FIG. 8 is a scatter diagram illustrating relationships between elongations and tensile strengths of an aluminum alloy casting according to the present invention, a conventional aluminum alloy casting and a conventional aluminum alloy forged product.

The thus prepared test samples were subjected to the tensile test to evaluate their tensile strengths and elongations. The results of the Fifth Evaluation are illustrated in FIG. 8. It is apparent from FIG. 8 that not only the tensile strength of the present aluminum alloy casting but also the elongation thereof were far superior to those of the conventional aluminum alloy casting and that they were even better than those of the conventional aluminum alloy forged product. Hence, it is possible to use the aluminum alloy casting according to the present invention in order to produce automobile parts which should be light-weighted but which should exhibit an enhanced strength as well.

Sixth Evaluation

A Sixth Evaluation was carried out in order to compare a fatigue resistance of the aluminum alloy casting according to the present invention with that of a conventional aluminum alloy forged product. The aluminum alloy casting according to the present invention was prepared with the same raw material as the First Preferred Embodiment under the same conditions for preparing the aluminum alloy casting of the First Preferred Embodiment. The conventional aluminum alloy forged product was prepared with the conventional aluminum alloy ("6061" as per JIS). However, in the Sixth Evaluation, the casting and forged product were formed into the cylindrical test specimens having a diameter of 30 mm which were prepared in the First Evaluation, and the test specimens were machined to the test samples which had a configuration in accordance with the JIS #4 sample.

Figure 9:
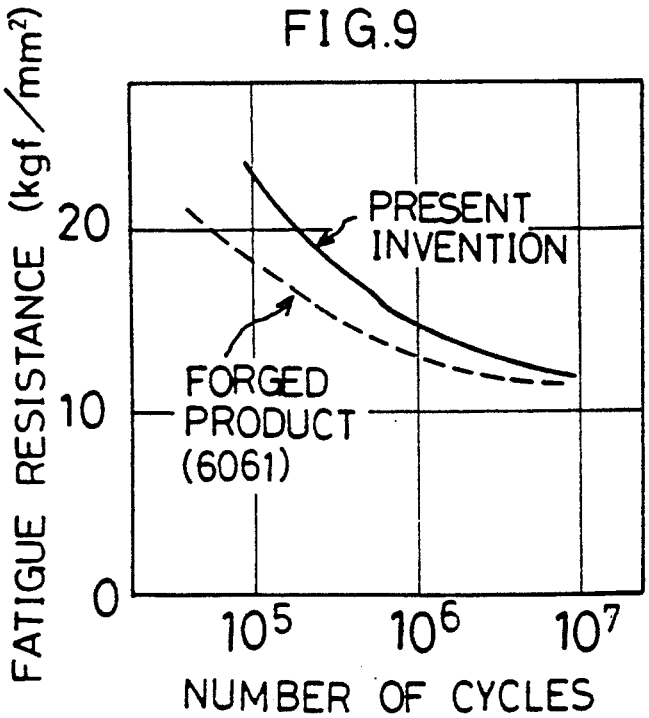
FIG. 9 is a graph illustrating relationships between number of repeated loading and unloading cycles and fatigue strengths of an aluminum alloy casting according to the present invention and a conventional aluminum alloy forged product.

The thus prepared test samples were subjected to a fatigue resistance test to evaluate their fatigue resistances when they were subjected to a repetitive loading and unloading cycle. In the repetitive loading and unloading cycle, the test samples were set on a rotary bending stress machine which is operated at a rotary speed of 3000 rpm. The results of the Sixth Evaluation are illustrated in FIG. 9. FIG. 9 definitely tells us that the fatigue resistance of the present aluminum alloy casting was better than that of the conventional aluminum alloy forged product. Hence, the aluminum alloy casting according to the present invention is much tougher than the conventional aluminum forged product, and such an excellent toughness lasts longer than that of the conventional aluminum forged product.

Third Preferred Embodiment

In the Third Preferred Embodiment, an aluminum alloy according to the present invention was cast under the same casting conditions as those for the suspension arm of the First Preferred Embodiment, and the cylindrical test specimen having a diameter of 30 mm was obtained. The aluminum alloy included Sr in predetermined amounts in addition to Si in an amount of 4.0% by weight, Cu in an amount of 2.0% by weight, Mg in an amount of 0.3% by weight, and substantially the balance of Al as well as inevitable impurities. The Sr addition amount was varied from 0, 0.002, 0.005, 0.01, 0.5, 0.2 and to 0.3% by weight. A test sample having the JIS #4 configuration was machined out of the test specimen. The solution treatment was carried out onto the test sample under the same solution treatment conditions as those for the suspension arm of the First Preferred Embodiment. The thus obtained test samples were out in order to measure a maximum grain size of the eutectic Si phases at the central portion of the cross section. The results of this measurement are illustrated in FIG. 10.

Figure 10:
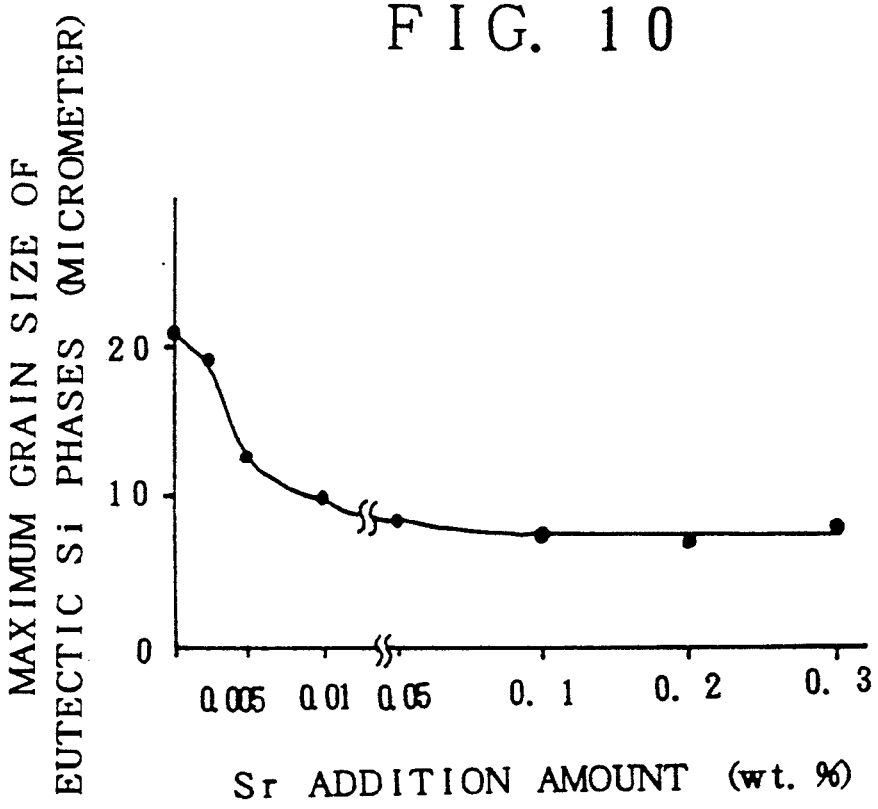
FIG. 10 is a graph illustrating variations of maximum grain sizes of the eutectic Si phases of aluminum alloy castings whose Sr addition amounts are varied.

As can be seen from FIG. 10, when Sr is added in an amount of 0.005% by weight or more, there appears the advantageous effect of the modified Si phases, and the mechanical properties were improved, in particular the elongation was improved. When Sr is added in an amount of more than 0.2% by weight, though the Si phases are modified, the Sr compounds crystallize and the elongation deteriorates. Thus, when the present aluminum alloy and the raw material for the present production process include Sr in an amount of 0.005 to 0.2% by weight, the strength and toughness of the aluminum alloy casting are improved, and they are stabilized. The stabilization of the strength and toughness herein means that the lower value of the elongation, for instance, increases and approaches to the upper value so that the performance, i.e. , the elongation, of the aluminum alloy casting hardly varies.

Having now fully described the present invention, it will be apparent to one of ordinary skill in the art that many changes and modifications can be made thereto without departing from the spirit or scope of the present invention as set forth herein including the appended claims.

What is claimed is:

1. A process for producing an aluminum alloy casting having a high strength and a high toughness, the process comprising the steps of:

melting a raw material comprising:

silicon (Si) in an amount of 2.5 to 4.4% by weight;

copper (Cu) in an amount of 1.5 to 2.5% by weight;

magnesium (Mg) in an amount of 0.2 to 0.5% by weight; and the balance of aluminum (Al);

squeeze casting a molten metal of said raw material with a mold while applying a pressure of 250 to 1500 kgf/cm$^2$ thereto; and carrying out a solution treatment onto a cast product.

2. The process for producing an aluminum alloy casting having a high strength and a high toughness according to claim 1, wherein said raw material includes silicon (Si) in an amount of 3.0 to 4.0% by weight.

3. The process for producing an aluminum alloy casting having a high strength and a high toughness according to claim 1, wherein said raw material includes said copper (Cu) in an amount of 1.8 to 2.3% by weight.

4. The process for producing an aluminum alloy casting having a high strength and a high toughness according to claim 1, wherein said raw material includes said magnesium (Mg) in an amount of 0.3 to 0.5% by weight.

5. The process for producing an aluminum alloy casting having a high strength and a high toughness according to claim 1, wherein said squeeze casting is carried out by applying a pressure of 300 to 1000 kgf/cm$^2$ to said molten metal.

6. The process for producing an aluminum alloy casting having a high strength and a high toughness according to claim 1, wherein said heat treatment step comprises the steps of:

leaving said cast product at a temperature of 520° to 550° C. for 3 to 10 hours for solution treatment to dissolve said Cu, Mg, Si, into an Al matrix in sufficient amounts and at the same time spheroidize any eutectic silicon phases, and thereby improving the strength and the toughness of said aluminum alloy casting;

quenching said cast product; and aging said cast product at a temperature of 150° to 190° C. for 2 to 10 hours.

7. The process for producing an aluminum alloy casting having a high strength and a high toughness according to claim 6, wherein said heat treatment step results in spheroidized eutectic silicon phases having a size of not more than 20 micrometers.

8. The process for producing an aluminum alloy casting having a high strength and a high toughness according to claim 6, wherein said solution treatment is carried out at a temperature of 530' to 535° C. for 3 to 6 hours.

9. The process for producing an aluminum alloy casting having a high strength and a high toughness according to claim 6, wherein said aging is carried out at a temperature of 160° to 180° C. for 2 to 6 hours.

10. The process for producing an aluminum alloy casting having a high strength and a high toughness according to claim 1, wherein said mold is evacuated to a vacuum degree of 30 Torr or less before carrying out said squeeze casting.

11. The process for producing an aluminum alloy casting having a high strength and a high toughness according to claim 1, wherein said raw material further includes strontium (Sr) in an amount of 0.005 to 0.2% by weight.

* * * * *

UNITED STATES PATENT AND TRADEMARK OFFICE

CERTIFICATE OF CORRECTION

PATENT NO. : 5,298,094

DATED : March 29, 1994

INVENTOR(S) : Ota et al.

It is certified that error appears in the above-indentified patent and that said Letters Patent is hereby corrected as shown below:

Column 14, line 14, change "520°" to --520--;
line 22, change "150°" TO --150--;
line 32, change "530′" to --530--;
line 36, change "160°" to --160--.

Signed and Sealed this

Twenty-fifth Day of April, 1995

Bruce Lehman

*Attest:*

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 5,298,094

DATED : March 29, 1994

INVENTOR(S) : Ota et al.

It is certified that error appears in the above-indentified patent and that said Letters Patent is hereby corrected as shown below:

TITLE PAGE:

The name of the second Assignee should read:

KABUSHIKI KAISHA TOYOTA CHUO KENKYUSHO

Signed and Sealed this

Fifth Day of August, 1997

Bruce Lehman

*Attest:*

BRUCE LEHMAN

*Attesting Officer*

*Commissioner of Patents and Trademarks*